US009327942B2

(12) United States Patent
Fukui et al.

(10) Patent No.: US 9,327,942 B2
(45) Date of Patent: May 3, 2016

(54) ELEVATOR ROPE SWAY DETECTION DEVICE

(75) Inventors: Daiki Fukui, Chiyoda-ku (JP); Seiji Watanabe, Chiyoda-ku (JP); Tsunehiro Higashinaka, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 455 days.

(21) Appl. No.: 14/001,792

(22) PCT Filed: Dec. 21, 2011

(86) PCT No.: PCT/JP2011/007145

§ 371 (c)(1),
(2), (4) Date: Aug. 27, 2013

(87) PCT Pub. No.: WO2012/117479

PCT Pub. Date: Sep. 7, 2012

(65) Prior Publication Data

US 2014/0000985 A1 Jan. 2, 2014

(30) Foreign Application Priority Data

Feb. 28, 2011 (JP) ..... 2011-042245

(51) Int. Cl.
*B66B 1/34* (2006.01)
*B66B 5/02* (2006.01)
(Continued)

(52) U.S. Cl.
CPC ..... *B66B 5/022* (2013.01); *B66B 5/0031* (2013.01); *B66B 7/06* (2013.01)

(58) Field of Classification Search
CPC ..... B66B 5/022; B66B 5/0031; B66B 7/06
USPC ..... 187/247, 277, 278, 292, 293, 391, 393, 187/412
See application file for complete search history.

(56) References Cited

U.S. PATENT DOCUMENTS 4,460,065 A 7/1984 Saxer
5,509,503 A * 4/1996 Salmon ..... B66B 11/08 187/266

(Continued)

FOREIGN PATENT DOCUMENTS

JP 55-35778 A 3/1980
JP 60-3764 U 1/1985

(Continued)

OTHER PUBLICATIONS

International Search Report issued Apr. 17, 2012 in PCT/JP2011/007145.

(Continued)

*Primary Examiner* — Anthony Salata
(74) *Attorney, Agent, or Firm* — Oblon, McClelland, Maier & Neustadt, L.L.P.

(57) ABSTRACT

An elevator rope sway detection method and a detection device using the same capable of detecting an elevator rope sway, generated by a building shake caused by an earthquake or strong wind, with high accuracy by preventing incorrect detections in detecting the elevator rope sway. A rope detector including a rope sway detector sends detection information detected by the rope detector to a rope determiner. A rope sway determination mechanism includes a detection signal memorization unit, a detection signal calculation unit, and a rope sway determination unit to determine that a rope sway occurs if the detection information sent from the rope detector fulfills a predetermined condition. A result determined by the rope sway determination unit is sent to an elevator controller, which performs an operation corresponding to the determined result.

10 Claims, 20 Drawing Sheets

(51) Int. Cl.
*B66B 5/00* (2006.01)
*B66B 7/06* (2006.01)

(56) References Cited

U.S. PATENT DOCUMENTS

| | | | | |
|---|---|---|---|---|
| 9,038,783 | B2 * | 5/2015 | Roberts | B66B 7/08 187/391 |
| 2013/0133983 | A1 * | 5/2013 | Mangini | B66B 5/021 187/277 |
| 2014/0069747 | A1 * | 3/2014 | Benosman | B66B 7/06 187/414 |
| 2014/0124300 | A1 * | 5/2014 | Benosman | B66B 7/06 187/247 |
| 2014/0224590 | A1 * | 8/2014 | Puranen | B66B 5/022 187/247 |
| 2014/0229011 | A1 * | 8/2014 | Fukui | B66B 7/06 700/275 |
| 2015/0008075 | A1 * | 1/2015 | Benosman | B66B 7/06 187/247 |
| 2015/0027814 | A1 * | 1/2015 | Benosman | B66B 5/02 187/247 |

FOREIGN PATENT DOCUMENTS

| | | | |
|---|---|---|---|
| JP | 61-7183 | A | 1/1986 |
| JP | 62-96286 | A | 5/1987 |
| JP | 5-319720 | A | 12/1993 |
| JP | 10-59644 | A | 3/1998 |
| JP | 2001-316058 | A | 11/2001 |
| JP | 2006-124102 | A | 5/2006 |
| JP | 2007-31049 | A | 2/2007 |
| JP | 2007-204223 | A | 8/2007 |
| JP | 2007-276895 | A | 10/2007 |
| JP | 2008-63112 | A | 3/2008 |
| JP | 2008-114944 | A | 5/2008 |
| JP | 2010-254476 | A | 11/2010 |

OTHER PUBLICATIONS

Written Opinion issued Apr. 17, 2012 in PCT/JP2011/007145 filed on Dec. 21, 2011( with English translaiton).

* cited by examiner

ELEVATOR ROPE SWAY DETECTION DEVICE

TECHNICAL FIELD

The present invention relates to an elevator rope sway detection method and a detection device using the same by which sways of an elevator rope such as a main rope, governor rope, or compensation rope are detected when an earthquake or strong wind shakes a building to cause the elevator rope to resonate with the building.

BACKGROUND ART

Recently, it is known that a high-rise building continues shaking at a low cycle time by a long-period ground motion or a strong wind whose influence is reported. In an elevator, there occurs a phenomenon that a rope such as a main rope, governor rope, or compensation rope has a period close to that of the building shakes to resonate, resulting in that the rope contacts hoistway devices thereby being damaged, or is caught thereby. If the elevator is operated with the rope caught by the hoistway devices, damages may occur in the hoistway devices, causing passengers to be entrapped or developing into a situation requiring a long time restoration.

In order to prevent such situations, an elevator rope sway detection device has been proposed to detect that the elevator rope sways more than a predetermined distance (refer to Patent document 1 or Patent document 2, for example).

PRIOR ART DOCUMENT

Patent Document

Patent document 1: Japanese Unexamined Utility Model Application Publication No. S60-003764 (page 1, FIG. 2)

Patent document 2: Japanese Patent Laid-Open No. 2001-316058 (page 11, FIG. 5)

SUMMARY OF THE INVENTION

Problem to be Solved by the Invention

In an elevator rope sway detection device described in Patent document 1 or Patent document 2, a rope sway displacement detection sensor is placed at a position that is near to the maximum amplitude point of rope, i.e. a detection object, in a hoistway and is at a predetermined distance apart from the normal position of the rope. When the elevator rope sway detection device detects a rope sway, it is usually expected that according to the sway amount, a sway stopper is started or a car is evacuated to a position where the elevator rope does not resonate.

In order to realize an efficient operation, there provided is a plurality of detection levels such as "a small detection level" for a rope sway amount under which the elevator car is not hindered from travelling and "a large detection level" for a rope sway amount over which the rope is in contact with devices of the hoistway. In a case where the plurality of detection levels are provided, rope sways in a normal operation condition are sequentially detected from the smallest level; however, especially in an elevator that is installed outdoors, there has been an incorrect detection problem in that detections are not sequentially made because of wafting objects or passing-by birds.

In addition, in a case where a photoelectric sensor whose components face each other to emit and receive a beam is used as a sensor for detecting a rope sway displacement, an inexpensive beam-emitting-receiving sensor generally makes a detection in a manner that a beam emitting component thereof emits a beam at a large view angle and a beam receiving component thereof detects, with a small view angle, the beam only from a predetermined position. Therefore, when using the sensors to realize a plurality of levels, there has also been a problem that a beam from an adjacent beam emitting component is incorrectly received and detected.

The present invention is made to solve the problems described above, and provides an elevator rope sway detection method and a detection device using the same for detecting, at a plurality of levels, an amount of elevator rope sway caused by a building shake resulting from a long-period ground motion or strong wind, and for reliably detecting elevator rope sways by preventing incorrect detections.

Means for Solving Problem

In an elevator rope sway detection method and a detection device using the same, the elevator rope sway detection device that detects horizontal sways of ropes installed in a hoistway of an elevator, includes a sway detection means that has two or more different detection levels for detecting predetermined sway displacements of the elevator ropes; a detection signal memorization unit that memorizes detection information from the sway detection means; a detection signal calculation unit that performs a predetermined calculation using the signal memorized in the detection signal memorization unit; a rope sway determination unit that determines, on the basis of a result calculated by the detection signal calculation unit, whether or not the detection information is produced by a rope sway; and an elevator controller that controls, on the basis of a result determined by the rope sway determination unit, the elevator so that the elevator performs a predetermined operation, wherein, only when a small detection level among the different detection levels is activated, the rope sway determination unit determines that activation of a large detection level is valid and that the activation is made by a rope sway.

Effect of the Invention

The present invention can provide non-conventional and remarkable effects such as prevention of incorrect detections of elevator rope sways and an accurate detection of elevator rope sways caused by a building shake resulting from an earthquake or strong wind.

MODES FOR CARRYING OUT THE INVENTION

Embodiment 1

Figure 1:
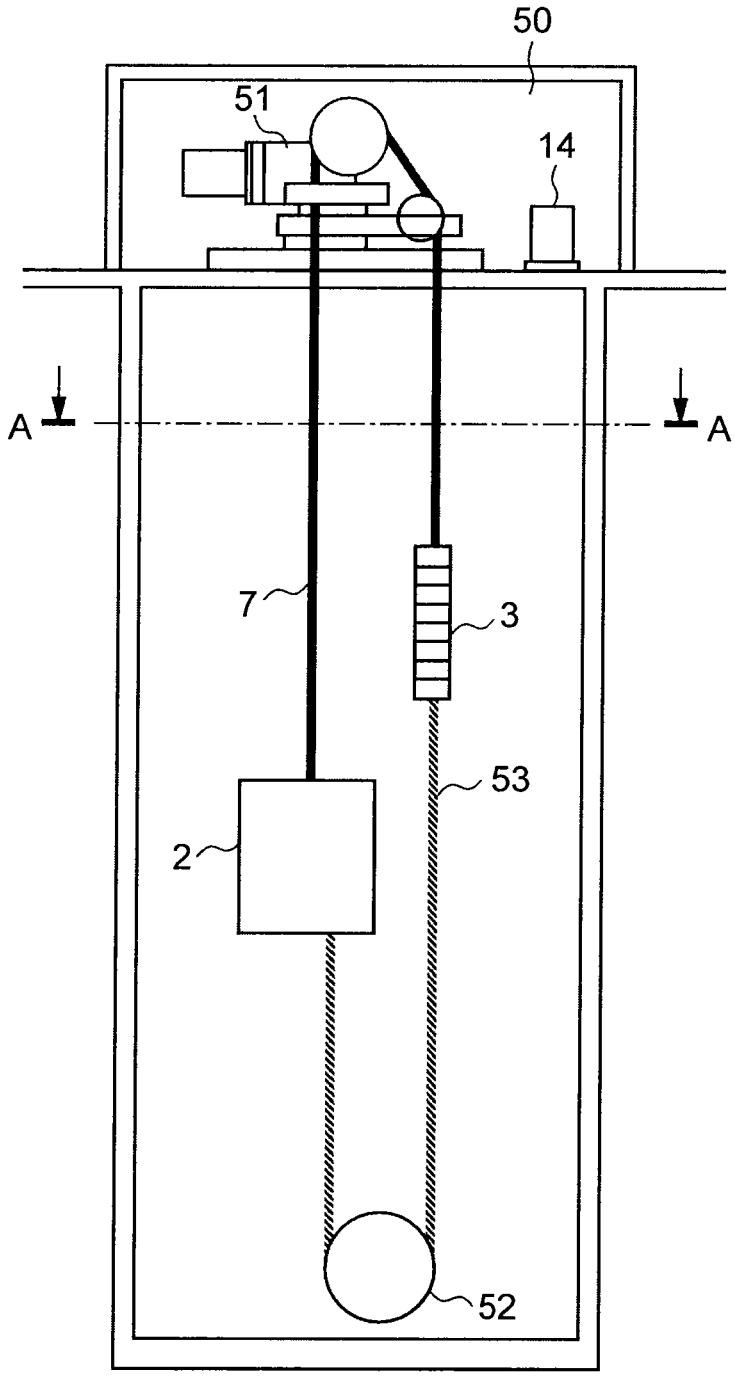
FIG. 1 is a view showing the structure of an elevator of Embodiment 1 according to the present invention.
Figure 2:
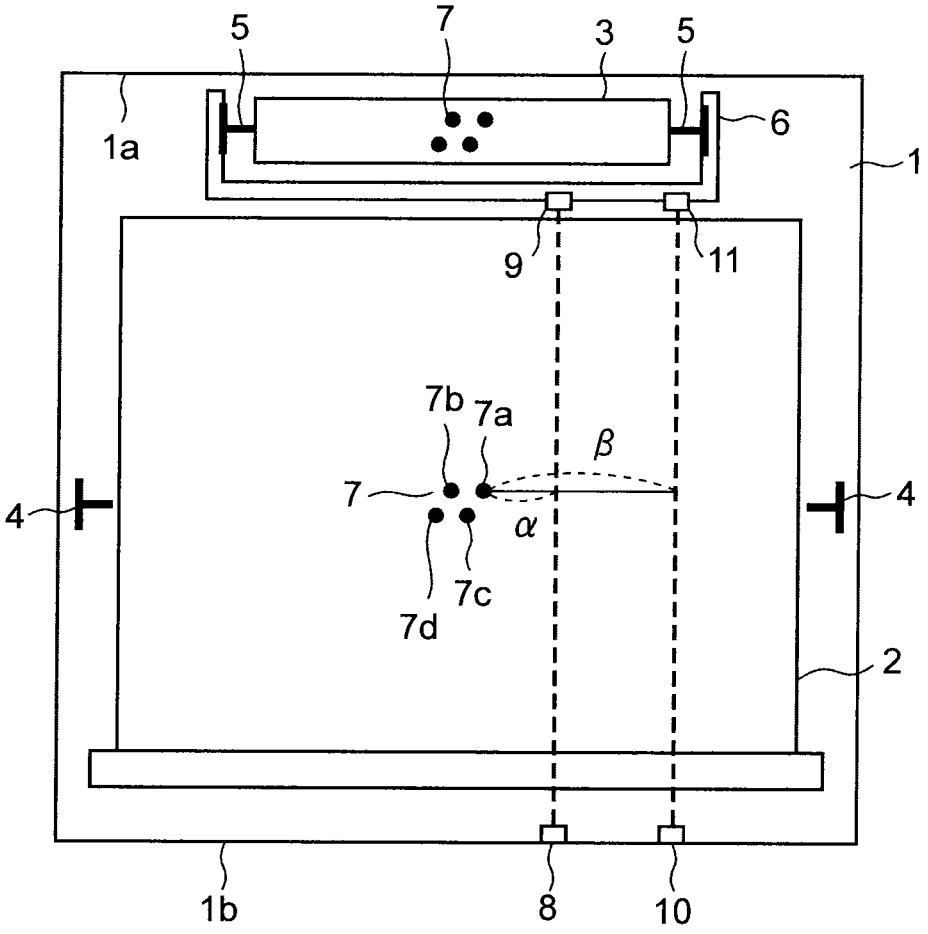
FIG. 2 is a plan view of a hoistway in the elevator of Embodiment 1 according to the present invention.
Figure 3:
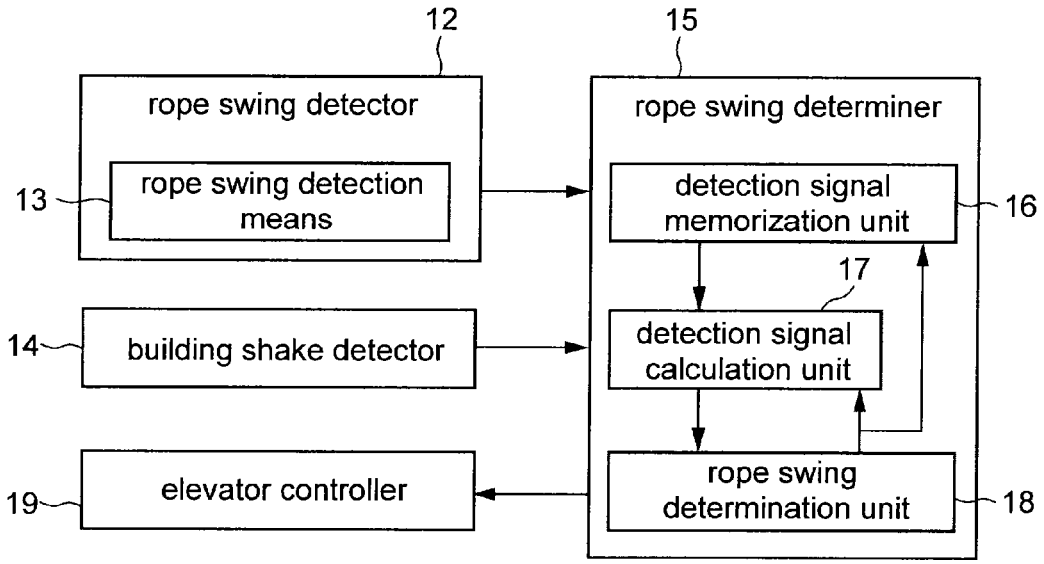
FIG. 3 is a block diagram illustrating a configuration of an elevator rope sway detection device of Embodiment 1 according to the present invention.

FIG. 1 is a structural view of an elevator of Embodiment 1 according to the present invention; FIG. 2 is a plan view showing the inside of a hoistway in the elevator of Embodiment 1 according to the present invention; FIG. 3 is a block diagram illustrating a configuration of an elevator rope sway detection device of Embodiment 1 according to the present invention. In FIGS. 1 to 3, illustrated are the hoistway 1 of the elevator, a car 2 travelling upward and downward in the hoistway 1, a counter weight 3 travelling upward and downward in the hoistway 1 in reverse directions of the car 2, a pair of car guide rails 4 placed in the hoistway 1 for guiding the car 2 to travel upward and downward, a pair of counter weight guide rails 5 placed in the hoistway 1 for guiding the counter weight to travel upward and downward, a support bracket 6 for supporting the counter weight guide rails 5, placed on, for example, a hoistway wall 1*a*, i.e. a back side wall adjacent to the counter weight 3, a plurality of main ropes 7 suspending the car 2 and the counter weight 3 in a manner of a pulley system. Furthermore, a compensation rope 53 connects the bottom of the car 2 to that of the counter weight 3 through a balance pulley 52.

Middle portions of the main ropes 7 are wound around a driving pulley of a traction machine 51 installed in a machine room 50 in or above the hoistway 1. Thus, rotation of the driving pulley simultaneously causes movement of the main ropes 7, thereby simultaneously making the car 2 travel upward or downward in the hoistway 1. Hereupon, FIG. 2 shows a case in which four main ropes 7 suspend the car and the counter weight 3 in a manner of a pulley system including a pulley and two objects, and symbols 7*a* to 7*d* designate parts that are placed above the car for suspending the car 2 (referred to as "above-car suspender parts", hereinafter). In addition, the above-car suspender parts 7*a* to 7*d* include portions of the main ropes 7 such as those between end portions connected with the top of the car 2 and the driving pulley placed in the machine room 50 or those between a suspension pulley provided on the top of the car 2 and a return pulley provided at a top portion of the hoistway 1. Here, displacements of the above-car suspender parts 7*a* to 7*d* of the main ropes 7 on an approximately-perpendicularly-projected plane in the hoistway 1 are limited within a predetermined range, such as a displacement made by sways.

Furthermore, in the hoistway 1, beam emitting components 8 and 10 are provided at a predetermined height on a fixed structure such as a hoistway wall 1*b*, i.e. a front side wall in which a floor doorway is formed; and beam receiving components 9 and 11 are provided at an approximately the same height as the beam emitting components 8 and 10 on a fixed structure of the hoistway such as the support bracket 6.

In addition, in order to prevent the car 2 and the counter weight 3 traveling upward and downward in the hoistway 1 from colliding with the beam emitting components 8 and 10 and the beam receiving components 9 and 11, the components are arranged when viewed on a perpendicularly-projected plane so as not to interfere with traveling of the car 2 and the counter weight 3. Here, the beam emitting component 8 and the beam receiving component 9 provide a detection line that is positioned a predetermined distance $\alpha$ apart from a normal suspension position where the above-car suspender part 7*a* should originally be placed (hereinafter, referred to as "the normal suspension position"), to detect a sway of a first level; the beam emitting component 10 and the beam receiving component 11 provide another detection line that is positioned a predetermined distance $\beta$ apart from the normal suspension position of the above-car suspender part 7*a*, to detect a sway of a second level.

Furthermore, the beam emitting component 8 for the first sway detection level emits a beam, which is received by the beam receiving component 9 and the axis of which is positioned the predetermined distance $\alpha$ apart from the normal suspension position where the above-car suspender part 7*a* should originally be placed; similarly, the beam emitting component 10 for the second sway detection level emits a beam, which is received by the beam receiving component 11 and the axis of which is positioned the predetermined distance $\beta$ apart from the normal suspension position where the above-car suspender part 7*a* should originally be placed. Here, the predetermined distances $\alpha$ and $\beta$ ($\alpha<\beta$) correspond to a small detection level and a large detection level, respectively, for detecting sway amounts of the rope.

Thus, in a condition that the respective above-car suspender parts 7*a* to 7*d* of the main rope 7 stay at normal suspension positions, the beams emitted from the beam emitting components 8 and 10 are received by the corresponding beam receiving components 9 and 11, respectively; on the other hand, in a condition that the respective above-car suspender parts 7*a* to 7*d* of the main rope 7 sway to pass across the beam axes of the first and/or second detection lines, the beams emitted from the beam emitting component 8 and/or 10 are blocked by the respective above-car suspender parts 7*a* to 7*d* so that the corresponding beam receiving components 9 and/or 11 do not receive the beams, to thereby detect a rope sway.

The beam emitting components 8 and 10 and the beam receiving components 9 and 11, i.e. a rope sway detection means 13, are included in a rope detector 12 which sends information detected by the rope detection means 13 to a rope determiner 15; on the top of the building, a building shake detector 14 is installed to detect shaking of the building and sends the detected building shake information to the rope determiner 15. The rope sway determination means 13 includes a detection signal memorization unit 16, a detection signal calculation unit 17, and a rope sway determination unit 18; the detection memorization unit 16 stores the detected information sent from the rope detector 12, the detection signal calculation unit 17 performs a predetermined calculation on the basis of the information stored in the detection signal memorization unit 16 to send calculated results to the rope sway determination unit 18. If the building shake information from the building shake detector and the calculated results fulfill predetermined conditions, the rope sway determination unit 18 determines that the rope sways.

On the other hand, if the building shake information and the calculated results do not fulfill the predetermined conditions, the rope sway determination unit 18 determines that a rope sway does not occur. The result determined by the rope sway determination unit 18 is sent to an elevator controller 19, which then performs operations according the determined result. At that time, as a predetermined condition for the building shake information, used is an acceleration at a building floor on which the machine room 50 exists to accommodate the traction machine 51 for the elevator, which will be described below.

Figure 4:
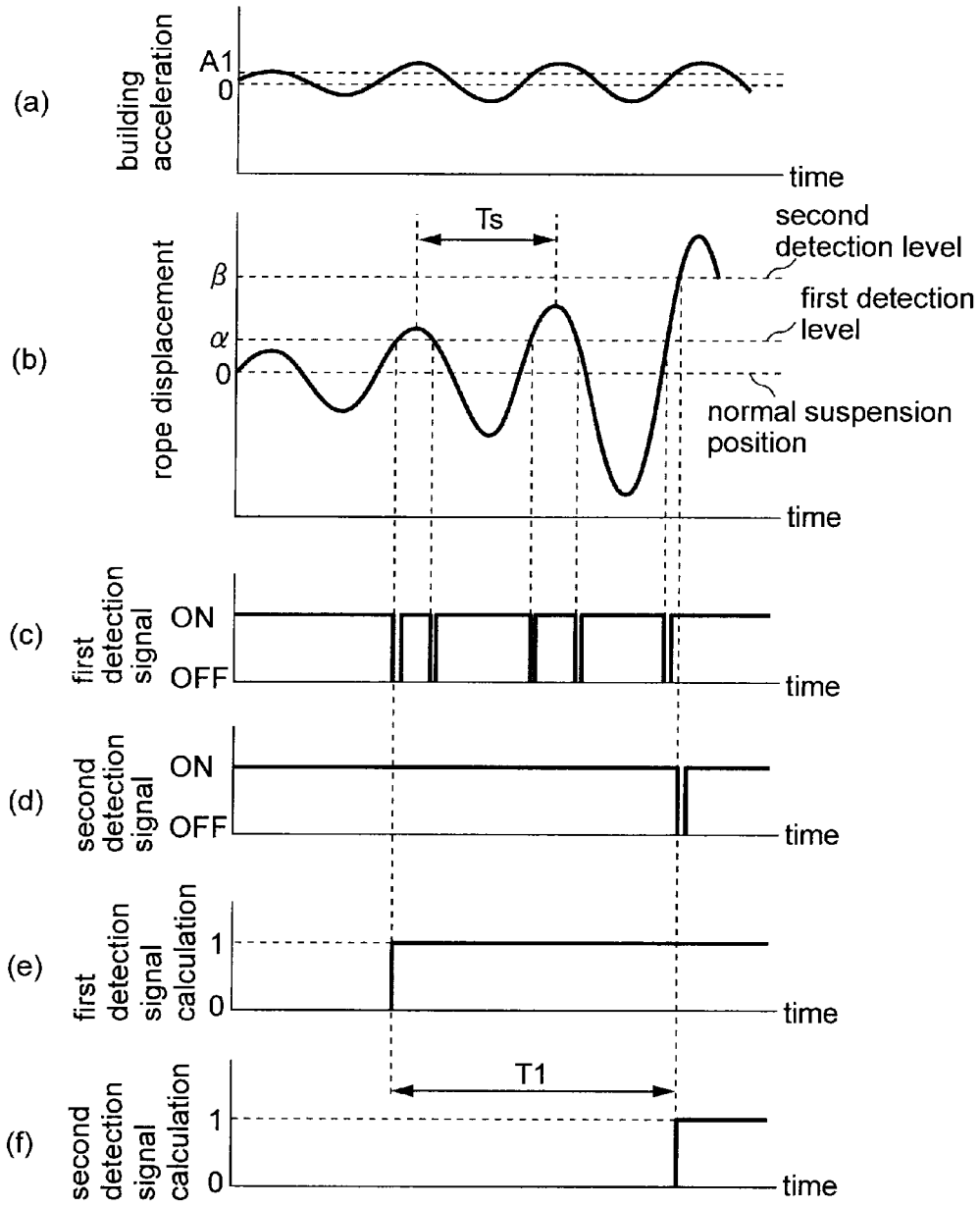
FIG. 4 are graphs for explaining operations of the elevator rope sway detection device of Embodiment 1 according to the present invention.

FIG. 4 show specifically a situation in which an earthquake or strong wind causes a building shake shown in FIG. 4 (*a*), then, when the above-car suspender parts 7*a* to 7*d* resonate and start swaying at a building shake frequency, a rope displacement develops as shown in FIG. 4 (*b*). For simplification, FIG. 4 (*b*) shows only the above-car suspender part 7*a*. When the rope displacement reaches a first detection line positioned the predetermined distance $\alpha$ apart from the normal suspension position of the above-car suspender part 7*a*, a beam emitted from the first beam emitting component 8 is blocked so that the beam is not received by the beam receiving component 9, causing the rope sway detection means to transition from ON state (no detection) to OFF state (detection) and send a first detection signal as shown in FIG. 4 (*c*) to a rope sway determiner. Similarly, when the rope displacement reaches a second detection line positioned the predetermined distance $\beta$ apart from the normal suspension position of the above-car suspender part 7*a*, a beam emitted from the second beam emitting component 10 is blocked so that the beam is not received by the beam receiving component 11, causing the rope sway detection means to transition from ON state to OFF state and send a second detection signal as shown in FIG. 4 (*d*) to the rope sway determiner 15.

The signals sent in this way are stored as time series data shown in FIGS. 4 (*c*) and (*d*) in the detection signal memorization unit provided in the rope sway determiner. Next, the data stored in the detection signal memorization unit are sent to the detection signal calculation unit, which holds timing at which each of the first and second detection signals is first activated as shown in FIGS. 4 (*e*) and (*f*) and sends the timings to the rope sway determination unit. As shown in FIG. 4 (*b*), the rope displacement gradually develops in a vibration waveform. Therefore, as for detection order, the first detection level is to be activated earlier than the second detection level.

Figure 5:
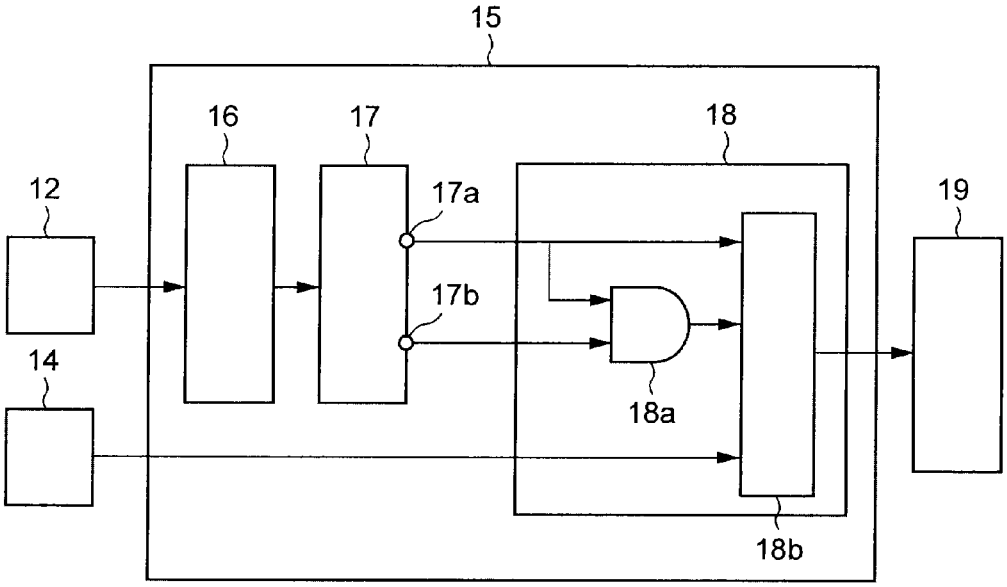
FIG. 5 is a signal block diagram of the elevator rope sway detection device of Embodiment 1 according to the present invention.

In the rope sway determination unit 18, these things are utilized as shown in FIG. 5. That is, a rope sway determination unit CPU 18*b* receives a first-detection-signal activation timing 17*a* from the detection signal calculation unit, an output of a circuit 18*a* ANDing the first and a second detection signal activation timings 17*a* and 17*b*, and the building shake information sent from the building shake detector; then, if the output of the AND circuit is ON and the building shake information sent from the building shake detector is a predetermined value A1 (refer to FIG. 4 (*a*), the same goes for the following) or larger, it is determined that the second detection signal is activated by a rope sway resulting from a building shake, and an instruction for an elevator operation such as an operation to move to a nearest floor and halt, an operation to evacuate to a floor where the rope resonance does not occur, or an emergency halt is sent to the elevator controller.

On the other hand, if the building shake information is smaller than the predetermined value A1, the rope sway determination unit CPU determines that the rope sway is not caused by the building shake, and sends to the elevator controller an elevator operation instruction such as an instruction to move to a nearest floor and halt, or an emergency halt instruction.

Furthermore, if the first detection signal is not activated before the second detection signal is activated, the rope sway determination unit CPU determines that respective level detections are made not by a rope sway, and then sends reset signals to the detection signal memorization unit and the detection signal calculation unit to reset the memorized data and the calculated data.

Figure 6:
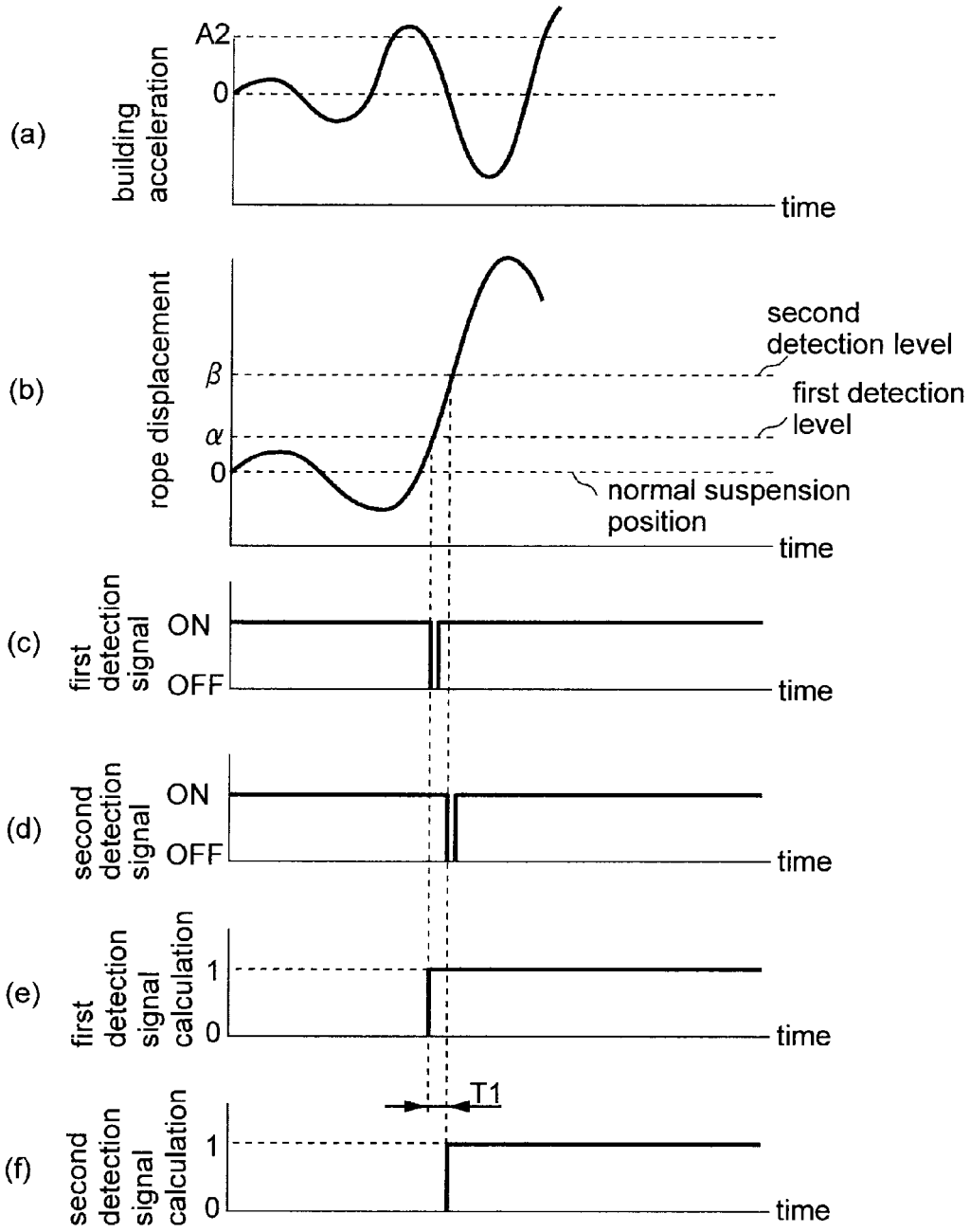
FIG. 6 are graphs for explaining other operations of the elevator rope sway detection device of Embodiment 1 according to the present invention.

Next, an example will be described in which an activation time difference T1 between the respective levels as shown in FIGS. 4(*e*) and (*f*) is calculated from the first and second detection signal calculation results held in the detection signal calculation unit to be utilized for the rope sway determination. FIG. 6 show a case in which a large building shake occurs and causes the rope displacement to develop within a single wavelength from the first detection level of the predetermined distance $\alpha$ to the second detection level of the predetermined distance $\beta$, resulting that the activation time difference T1 becomes very short. On the other hand, if a large building shake does not occur in spite of a short activation time difference T1, it can be determined that such case is an incorrect detection.

Figure 7:
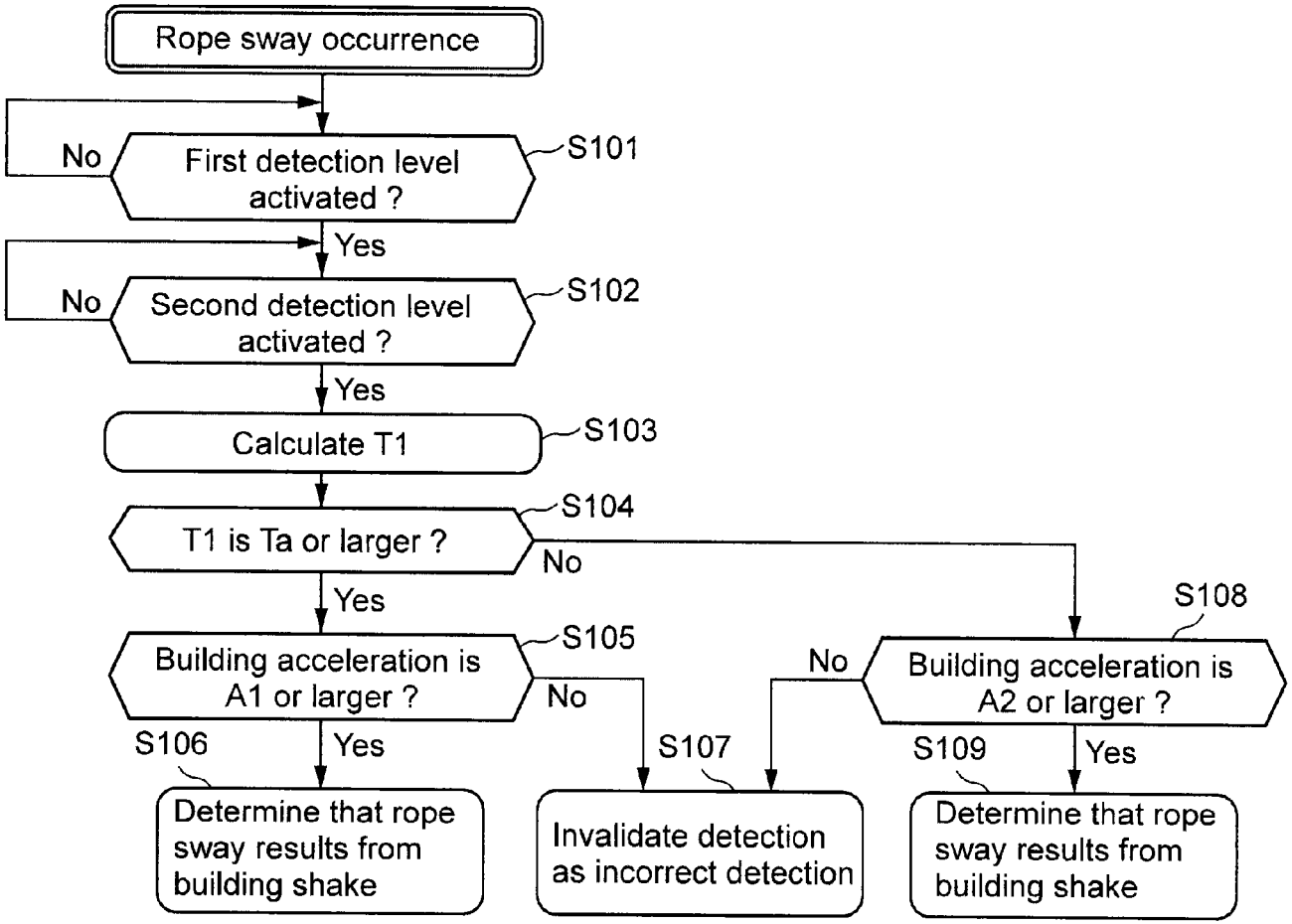
FIG. 7 is a flow chart for examining an activation time difference at any one of levels in Embodiment 1 according to the present invention.

FIG. 7 shows a specific flow chart. The first and second level displacements are detected at steps S101 and S102 to be held in the detection signal calculation unit, so that an activation time difference T1 between the respective levels is calculated at step S103. At step S104, the calculated activation time difference T1 is compared with a predetermined value Ta. In a case where the difference is the predetermined value Ta or more, building acceleration is checked at step S105 whether it is the predetermined value A1 or more; then if Yes, it is determined that the respective level detections are made by a rope sway resulting from a building shake. On the other hand, if the building acceleration is smaller than the predetermined value A1, it is determined that the respective level detections are not made by a rope sway resulting from a building shake, and then the detections may additionally be invalidated under a determination that they are incorrect detections. In a case where it is determined at step S105 that the activation time difference is smaller than the predetermined value Ta, the building acceleration is checked at step S108 whether it is a predetermined value A2 (refer to FIG. 6 (*a*), the same goes for the following) or larger; then, if the building acceleration is the predetermined value A2 or larger, it is determined that the respective level detections are made by a rope sway resulting from a building shake. If the building acceleration is smaller than the predetermined value A2, the detections are invalidated under a determination that they are incorrect detections.

At this time, the predetermined value A1 for determining a building shake may be set to be a value smaller than a building acceleration level that causes rope displacements to develop into at least the first detection level when the building shaking continues, as shown in FIG. 4 (*a*). By this setting, it can be determined that an activation of the second level is an incorrect detection under a condition that the building shake is smaller than the predetermined value A1. It is also recommended that the predetermined value A2 is set to be a value smaller than a building acceleration level that rapidly increases, as shown in FIG. 6 (*a*), rope displacements in a single or two wavelength period when a building shake occurs. In a case where the first and second detection levels are activated within a time difference smaller than Ta in spite of a building shake smaller than the predetermined value A2, such detections are invalidated under a determination that they are incorrect.

The predetermined value Ta for checking activation time differences is obtained from timings that are calculated in advance, using an elevator rope calculation model (such as Equation (1)), for the rope displacement to reach the respective levels when there occurs a maximum building shake acceleration at which the elevator can be safely operated. From a relation between the calculated value and a rope period Ts that is the inverse of the natural frequency of the rope, the rope period Ts multiplied by a coefficient may be used.

Assuming that a building shake is a sinusoidal vibration having a constant amplitude, a rope sway caused by the building shake can be considered as a chord vibration with no damping, allowing a rope sway displacement V in an example of the calculation model for the elevator rope to be expressed as a vibration equation as shown in Equation (1).

$$\frac{d^2V}{dt^2} + \omega_0^2(V - z\sin\omega t) = 0 \tag{1}$$

Here, respective symbols denote as follows: "t" denotes time; "V", a rope sway displacement (function of time); "z", a building displacement added to the rope; "ω", a natural frequency of the building; "$\omega_0$", a natural frequency of the rope (expressed as in Equation below, using: "L", a rope length; "T", a rope tension; "ρ", a rope linear density).

$$\omega_0 = \frac{\pi}{L}\sqrt{\frac{T}{\rho}} \tag{2}$$

Figure 8:
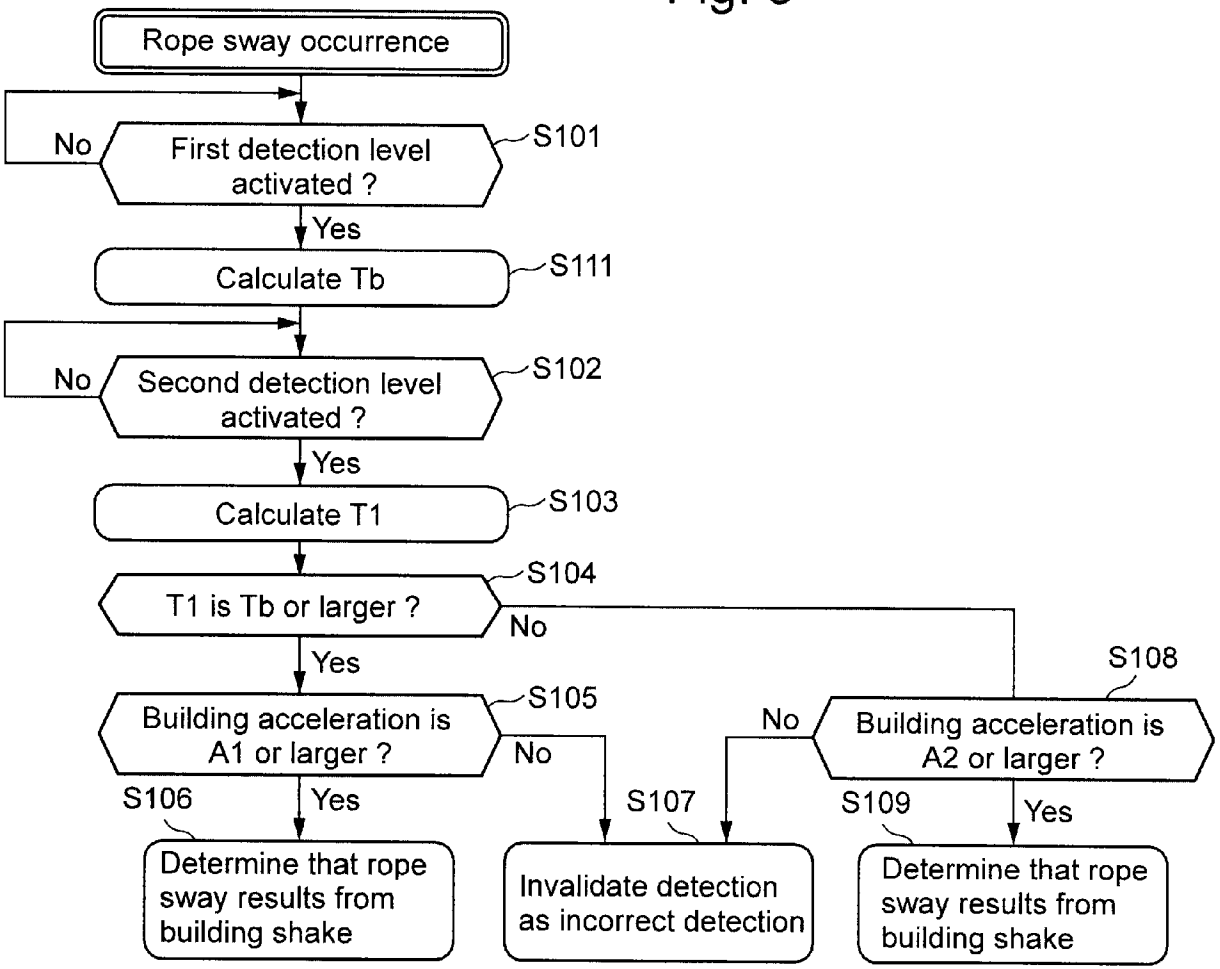
FIG. 8 is a flow chart for examining another activation time difference at any one of levels in Embodiment 1 according to the present invention.

Furthermore, another method may be used as shown in a flow chart of FIG. 8, in which after detecting a first detection level displacement, a building acceleration Aa detected at the detection time of the first detection level is inputted at step S111 to a calculation model provided in the detection signal calculation unit which includes the rope length, the rope tension, the rope linear density, and the like for estimating swaying of the elevator rope, and then a predetermined value Tb is set using the calculated timings of when the rope displacement reaches the respective levels. In this case, predetermined values A1 and A2 used at steps S105 and S108 for checking building acceleration may be set so as to have a relation to a building acceleration Aa, i.e. the acceleration when the first detection level is activated; for example, the predetermined value A1=2×Aa for determining whether or not a large building shake occurs, and the predetermined value A2=0.5×Aa for determining whether or not a building shake occurs. That is, by changing the building shake determination level according to the activation time difference T1, rope sway detections are made to be valid only when a rope sway results from a building shake, which thereby can prevent incorrect detections.

Figure 9:
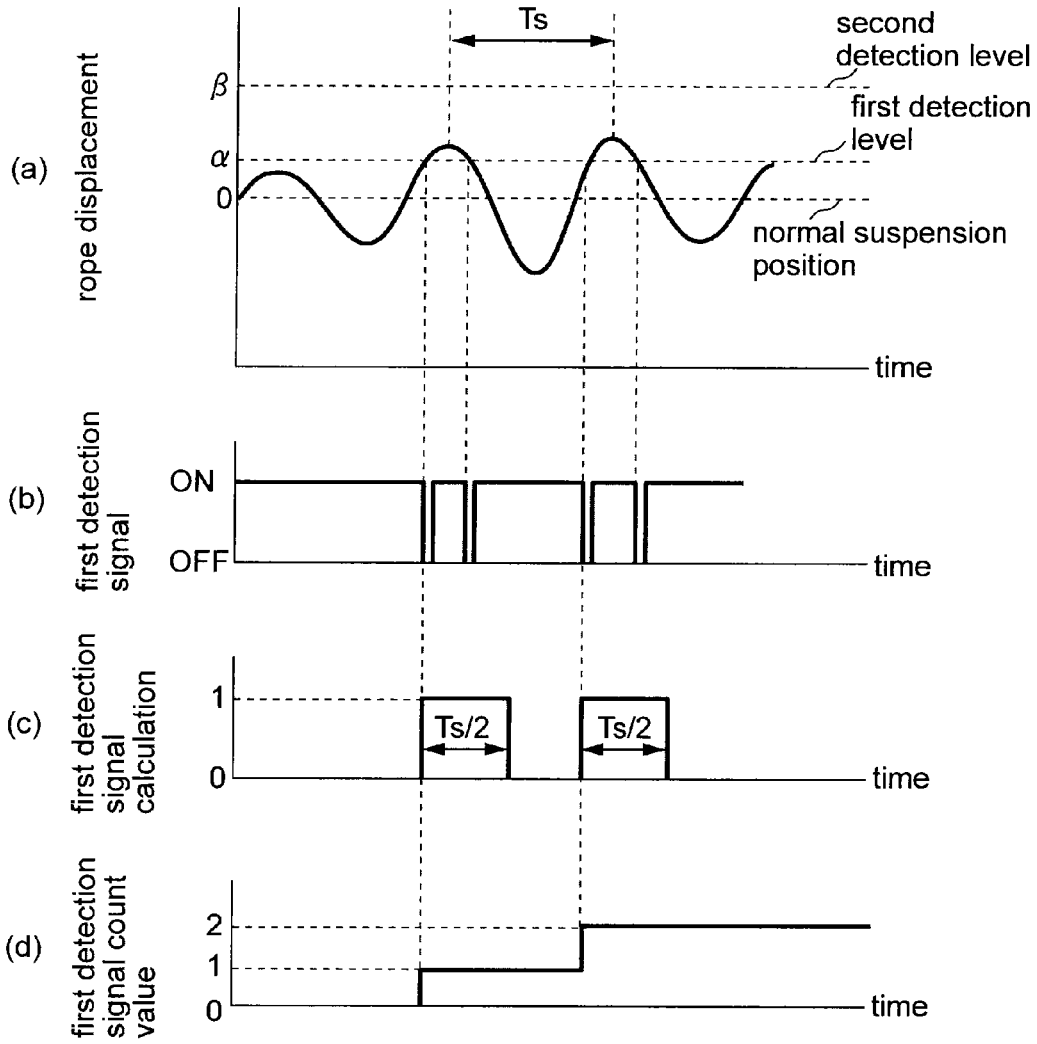
FIG. 9 are graphs for explaining other operations of the elevator rope sway detection device of Embodiment 1 according to the present invention.

In order to additionally perform a rope sway determination with respect to the first detection level, a timing at which the first detection signal has been first activated and held in the detection signal calculation unit is reset, for example as shown in FIG. 9 (*c*), after a lapse of Ts/2, i.e. a half of the rope period Ts, and then when the first detection signal is activated after the resetting, its activation timing is held again. These holding operations are counted, and then if the count value becomes the predetermined value or larger, the rope sway determination unit determines that displacements are made by a rope sway.

In a case where a building shake occurs by an earthquake, strong wind, or the like so that the rope resonates because the building shake period is close to the rope period, the elevator of Embodiment 1 according to the present invention can be efficiently operated, because the swaying of the rope is detected as signal information, the detected signal information is used to classify the detection into a detection made by a rope sway-event or into an incorrect detection, and then the building sway information is used to further determine whether or not the detection is made by a building shake, to give a proper elevator operation instruction at the rope sway event.

In addition, in the configuration of Embodiment 1, the building shake detector detects a building shake and sends the information to the rope determiner; however, even in a configuration without the building shake detector, the rope sway determiner can determine a rope sway event to thereby reliably detect only a rope sway.

In Embodiment 1, examples of an elevator operation have been explained in which an operation such as an operation to move to a nearest floor and halt, an evacuation operation, or an emergency halt is performed when determined that a rope sway is generated by a building shake; however, after performing such elevator operations, a normal elevator operation may be recovered if the rope sway determination unit does not detect rope sways after a period such as several minutes that is determined by taking aftershocks of the earthquake into account.

In Embodiment 1, the explanation has been made, using a beam-emitting-receiving photoelectric sensor as an example of the sway detection means; however, this is not a limitation, and it is needless to say that a device capable of measuring a rope-sway-displacement, for example an eddy current meter, an optical fiber, and a camera, can be used instead. In the above explanation, the target to be detected has been a main rope portion nearer to the car; however, similar effects are obtained when a main rope portion nearer to the counter weight, a compensation rope, a governor rope, or a control cable is used as the target to be detected.

Embodiment 2

Figure 10:
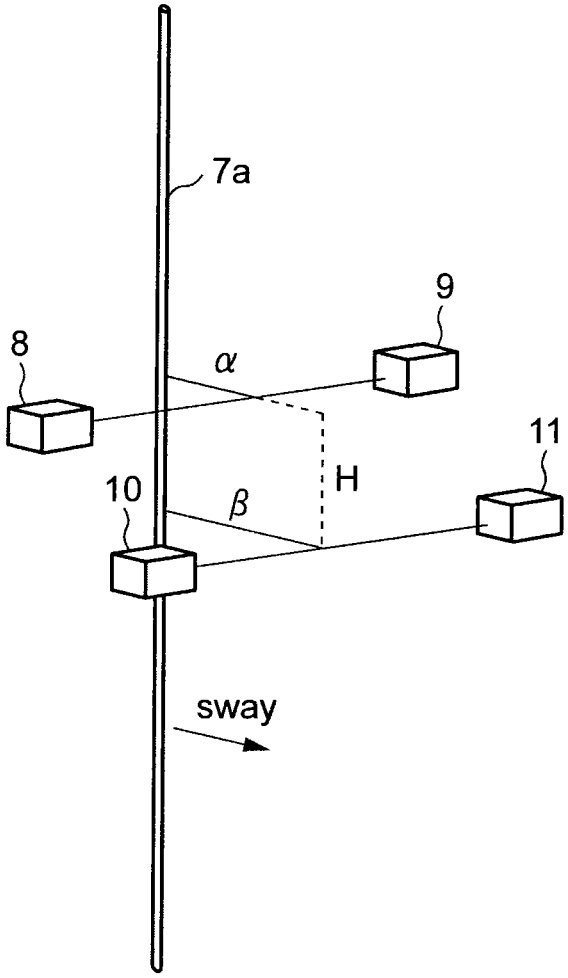
FIG. 10 is a schematic view of a configuration of an elevator rope sway detection device of Embodiment 2 according to the present invention.

FIG. 10 shows an example of an elevator rope sway detector of Embodiment 2 according to the present invention. The rope sway detector shown in FIG. 10 includes sway detection means, i.e. beam emitting components 8 and 10 and beam receiving components 9 and 11. The beam emitting component 8 and the beam receiving component 9 configure a detection line that is positioned the predetermined distance α apart from the normal suspension position of the above-car suspender part 7*a*, to detect a sway of a first level; the beam emitting component 10 and the beam receiving component 11 configure another detection line that is positioned the predetermined distance β apart from the normal suspension position of the above-car suspender part 7*a*, at a height shifted in a height direction by a predetermined distance H from the first sway detection line, to detect a sway of a second level. FIG. 10 shows only the above-car suspender part 7*a*, for simplification.

More specifically, when the above-car suspender part 7*a* resonates with a building shake generated by an earthquake or a strong-wind and starts swaying to cause a rope displacement to develop and reach the first detection level positioned the predetermined distance α apart from the normal suspension position of the above-car suspender part 7*a*, a beam emitted from the first beam emitting component 8 is blocked and then is not received by the beam receiving component 9, transitioning the rope sway detection means from ON state (no detection) to OFF state (detection). Similarly when the rope displacement reaches the second detection line positioned the predetermined distance β apart from the normal suspension position of the above-car suspender part 7*a*, at the height shifted in the height direction by the predetermined distance H, a beam emitted from the second beam emitting component 10 is blocked and then is not received by the beam receiving component 11, transitioning the rope sway detection means from ON state to OFF state.

Figure 11:
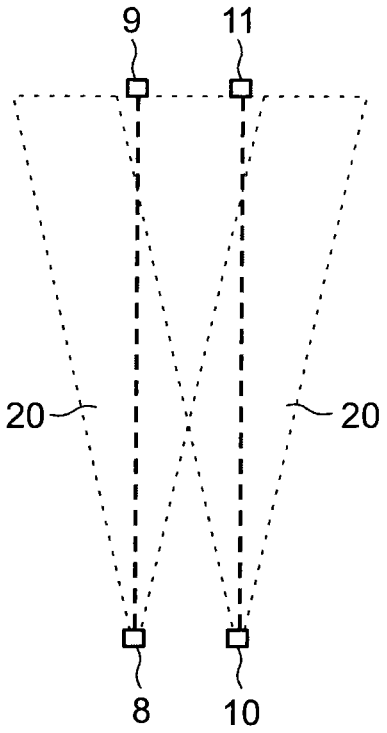
FIG. 11 is a schematic view showing an example of how optical beams spread when photoelectric sensors, used for the elevator rope sway detection device of Embodiment 2 according to the present invention, are parallel placed in a same plane.

At this point, spreads 20 (dotted triangle portions shown in FIG. 11) of the beam axes are illustrated in FIG. 11 in which the first and second sway detection lines are arranged in the same plane and beam-emitting-receiving photoelectric sensors are used as the rope sway detection means. When using inexpensive photoelectric sensors, it is general that a beam emitted from a beam emitting side spreads enough to cover a beam receiving surface on a beam receiving side, which detects a beam portion received at a predeterminately limited area. Therefore, if a plurality of detection lines is to be arranged so as to be close to each other, beams emitted from adjacent beam emitting components are received by a beam receiving component, sometimes resulting in incorrect detections; for example, when the rope displacement reaches the first detection line that is positioned the predetermined distance α apart from the normal suspension position of the above-car suspender part 7*a* to block a beam emitted from the first beam emitting component 8, it is expected that the beam is not received by the beam receiving component 9, causing the rope sway detection means to transition from ON state (no detection) to OFF state (detection), however, the beam receiving component 9 receives a beam emitted from the adjacent second beam emitting component 10 to cause a transition to ON state (no detection).

Figure 12:
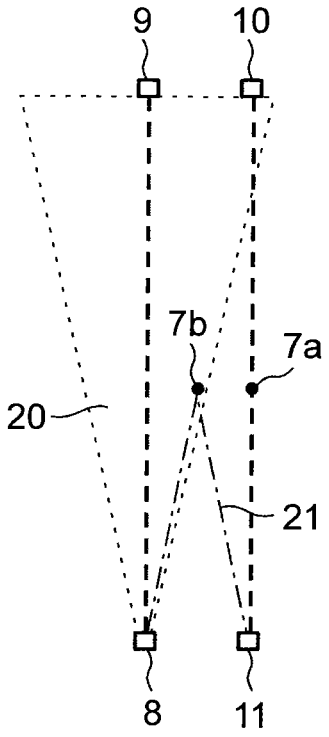
FIG. 12 is a schematic view showing an example of how the optical beams reflect when the photoelectric sensors, used for the elevator rope sway detection device of Embodiment 2 according to the present invention, are alternately placed in the same plane.

In order to prevent this phenomenon, there is another method in which adjacent beam-emitting-receiving components are alternately arranged as shown in FIG. 12; however, a concern is that when the above-car suspender part 7*a* resonates to start swaying and reaches the midpoint between the first and the second detection lines, the above-car suspender part 7*b* reflects a beam from the first beam emitting component 8 along a reflection path 21 (a dash and dotted line shown in FIG. 12). When the above-car suspender part 7*a* reaches the second detection line to block a beam from the second beam emitting component 10, it is originally expected, as shown in FIG. 12, that the beam is not received by the beam receiving component 11, causing a transition from ON state (no detection) to OFF state (detection), however, the second beam receiving component 11 receives the beam travelling along the reflection path 21 to cause a transition to ON state (no detection).

The rope sway detection device of Embodiment 2 according to the present invention uses photoelectric sensors for a plurality of detection lines serving as detection levels to prevent unnecessary incorrect detections, enabling a reliable rope sway detection. Furthermore, because a plurality of detection levels can be set, elevator operation instructions can be issued according to rope sway amounts, enabling an efficient elevator operation.

If combining Embodiment 1 with the technique of this embodiment in which respective detection levels are set at different heights, detections made by rope sway events can be distinguished from incorrect detections; and then, the determination of whether a detection is made by a building shake further prevents unnecessary incorrect detections, providing reliable rope sway detections. Elevator operation instructions under the combined techniques are issued only when a rope sway event is detected, enabling an efficient elevator operation.

Figure 13:
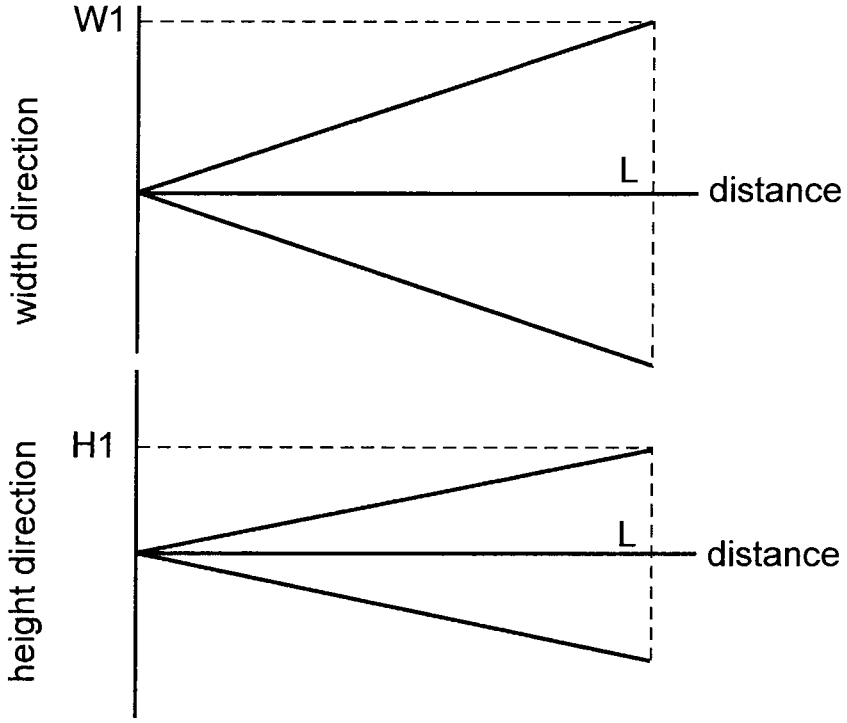
FIG. 13 is a schematic view showing an example of an optical beam characteristic of the photoelectric sensors used in the elevator rope sway detection device of Embodiment 2 according to the present invention.

Furthermore, in a case where the beam emitting components of the photoelectric sensors have, as shown in FIG. 13, a characteristic that when travelling over a distance L between the beam emitting component and the receiving component, the emitted beam expands its width to a distance W1 (in a horizontal cross-section of the hoistway) and expands its height to a distance H1 (perpendicularly to the horizontal cross-section of the hoistway), the predetermined distance H for shifting in the height direction is determined so as to be larger than the distance H1.

Figure 14:
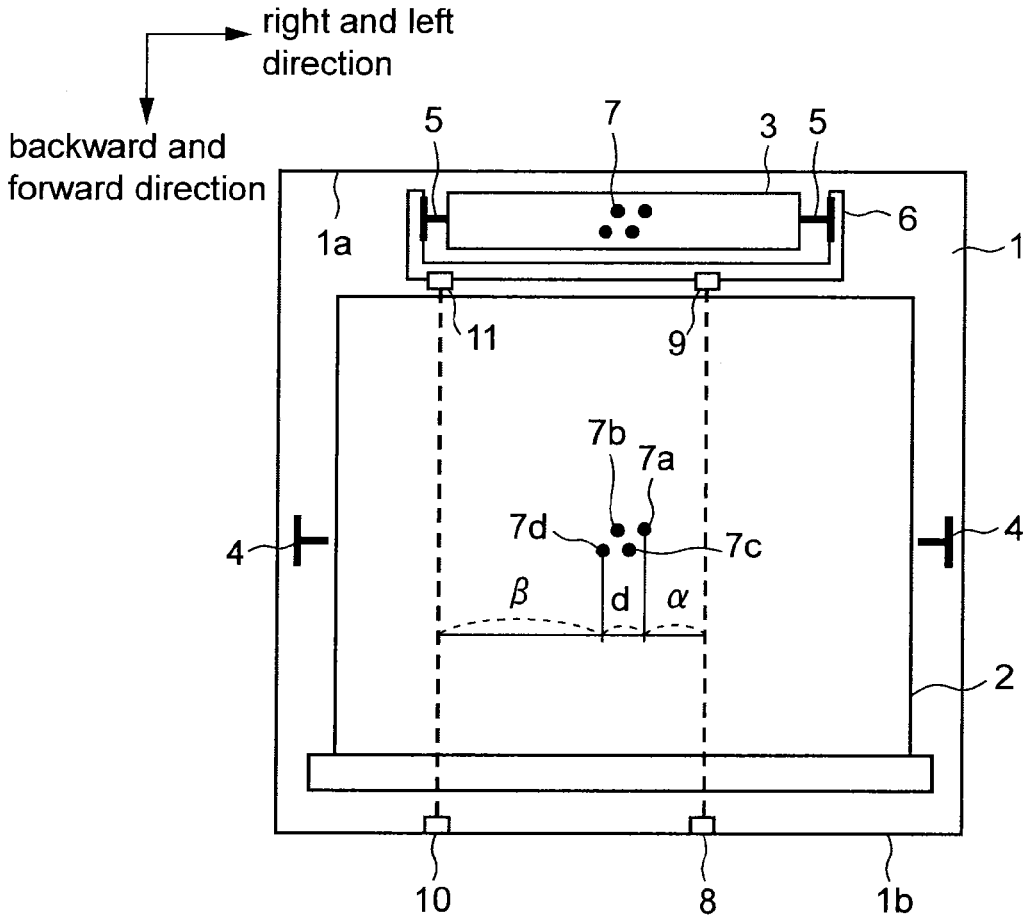
FIG. 14 is a plan view of an elevator hoistway showing an arrangement of the photoelectric sensors of Embodiment 2 according to the present invention.

FIG. 14 illustrates that on the basis of the width direction distance W1 described above, a detection line serving as the first detection level is arranged at a position the predetermined distance α apart from a normal suspension position of the above-car suspender part 7*a*, and a detection line serving as the second detection is arranged at a position the predetermined distance β apart from a normal suspension position of the above-car suspender part 7*d*. This arrangement is applicable when the distance between the first detection line and the second detection line (α+β+d, d: the distance between the normal suspension positions of the above-car suspender parts 7*a* and 7*d*) is larger than the distance W1.

In Embodiment 2, an example has been explained in which beam-emitting-receiving photoelectric sensors, i.e. the sway detection means, are arranged for a single axis direction to provide two detection lines for a rope sway direction; however, the photoelectric sensors may be arranged in two orthogonal axis directions to detect rope sways in an arbitrary direction, or may be arranged to surround the rope. Furthermore, three or more detection lines may be provided.

Furthermore, it is known that in an elevator in which a single car is suspended by a plurality of ropes, the tensions thereof are uneven. This sometimes causes the plurality of ropes not to synchronously sway in a same manner, when the rope sways are too small for the elevator car to be hindered from travelling. On the other hand, when the amplitudes of the rope sways are so large that the ropes are nearly in contact with the hoistway wall, the plurality of ropes sometimes sway synchronously despite of unevenness among the rope tensions. Thus, if a detection line serving as the first detection level is provided, as shown in FIG. 14, only for the above-car suspender part 7*a*, a detection delay occurs when the above-car suspender part 7*d* sways.

Figure 15:
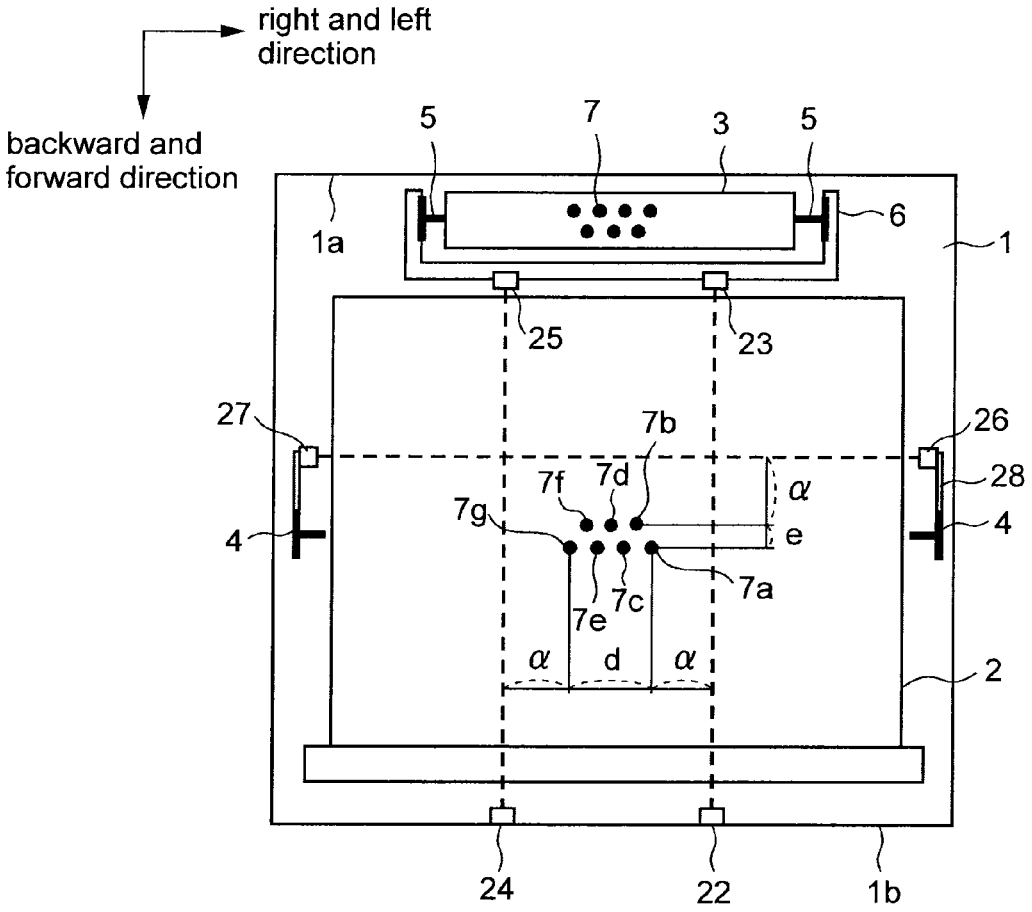
FIG. 15 is a plan view of the elevator hoistway showing another arrangement of the photoelectric sensors of Embodiment 2 according to the present invention.

Moreover, in the above-car suspender parts, a distance d between the right and left end ropes (a distance between the normal suspension positions of the above-car suspender parts 7*a* and 7*g*) is, as shown in FIG. 15, set up so as to be larger than a distance e between the front and back end ropes; thus, if only a first detection line is provided for detecting right and leftward sways, this causes a problem, i.e. a largely delayed detection.

Thus, for detecting right and leftward sways, detection lines serving as the first detection level are provided, as shown in FIG. 15; i.e., at positions that are the predetermined distance $\alpha$ apart rightward and leftward from the normal suspension positions of the above-car suspender parts 7*a* and 7*g*, respectively. On the other hand, the back and forward distance e between the ropes is small, therefore for detecting back and forward sways, another first detection line is provided at a position that is the predetermined distance $\alpha$ apart in a back and forward direction from the normal suspension position of the above-car suspender part 7*b*. This allows rope sways to be detected at a predetermined displacement without delay, even when unevenness in tensions of the plurality of the ropes causes the ropes to sway out of sync.

Figure 16:
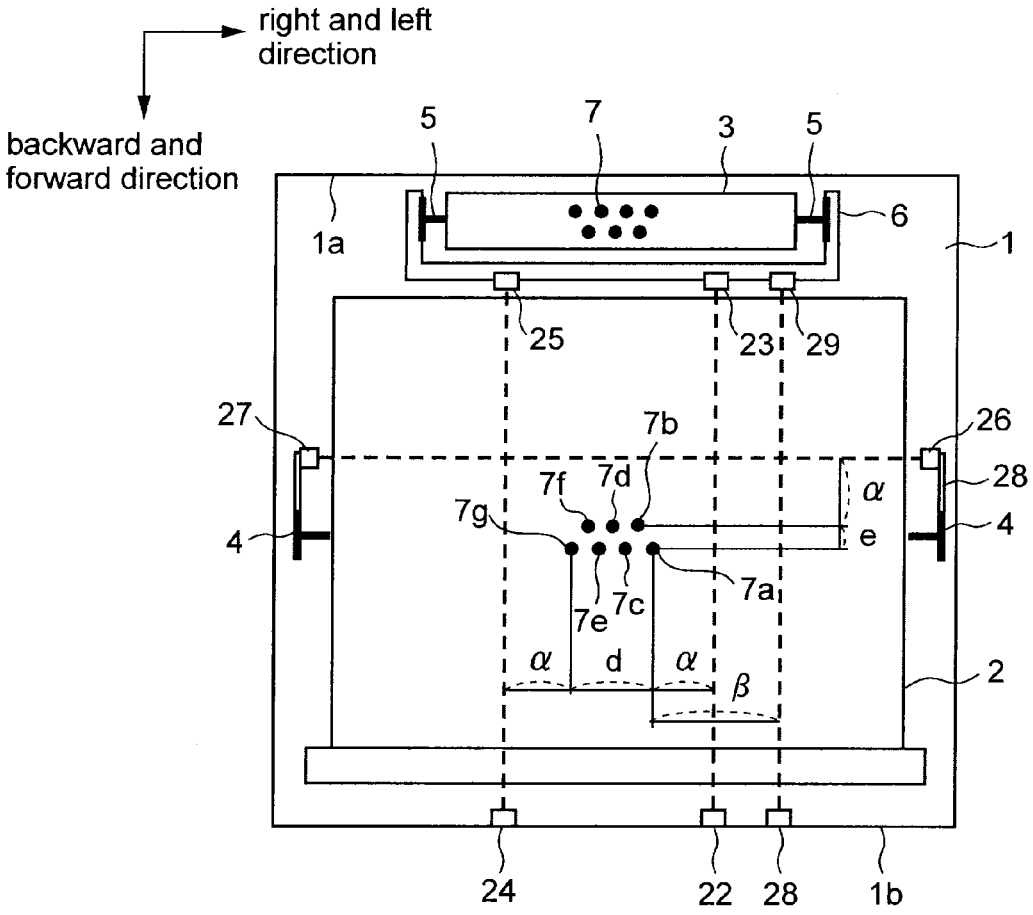
FIG. 16 is a plan view of the elevator hoistway showing another arrangement of the photoelectric sensors of Embodiment 2 according to the present invention.

FIG. 15 has shown an example for the first detection level; however, a similar arrangement may be made for the second detection level in which for right and leftward sways, detection levels are provided on the basis of the normal suspension position of the above-car suspender parts 7*a* and 7*g*, and for back and forward sways, a detection level is provided on the basis of the normal suspension position of the above-car suspender part 7*b*. In addition, in a case where the respective ropes synchronously sway with uneven tensions to reach a second detection level, the second detection level may be provided on the basis of only the above-car suspender part 7*a* for right and leftward sways, as shown in FIG. 16.

Figure 17:
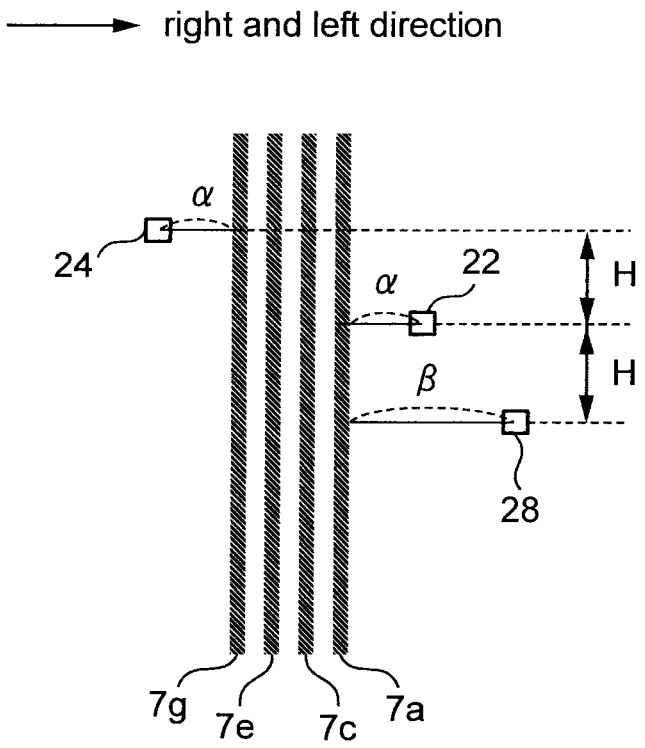
FIG. 17 is a front view of the hoistway showing a positional relation between main ropes and the photoelectric sensors arranged in another way in Embodiment 2 according to the present invention.

In a case where each of the rope sway detectors uses a beam emitting component of the photoelectric sensor that emits a beam expanding enough to cover the beam receiving surface of the beam receiving component, there occurs a case in which a right and leftward distance ($\alpha$+d+$\alpha$) between the two first detection lines, and a right and leftward distance ($\beta-\alpha$) between the first and second detection lines become smaller than the width direction distance W1 of the beam emitting component's characteristic shown in FIG. 13. In that case, one of the two first detection lines serving as the first detection level and the second detection line serving as the second detection level may be shifted, as shown in FIG. 17, in height directions by a predetermined distance H, respectively. The predetermined distance H is set as a value larger than the height distance H1 of the beam emitting component's characteristic.

FIG. 17 illustrates an example in which each shift is made by the predetermined distance H; however, the arrangements may be made with differently predetermined distances with each other as long as they are larger than the height direction distance H1 of the beam emitting component's characteristic.

Figure 18:
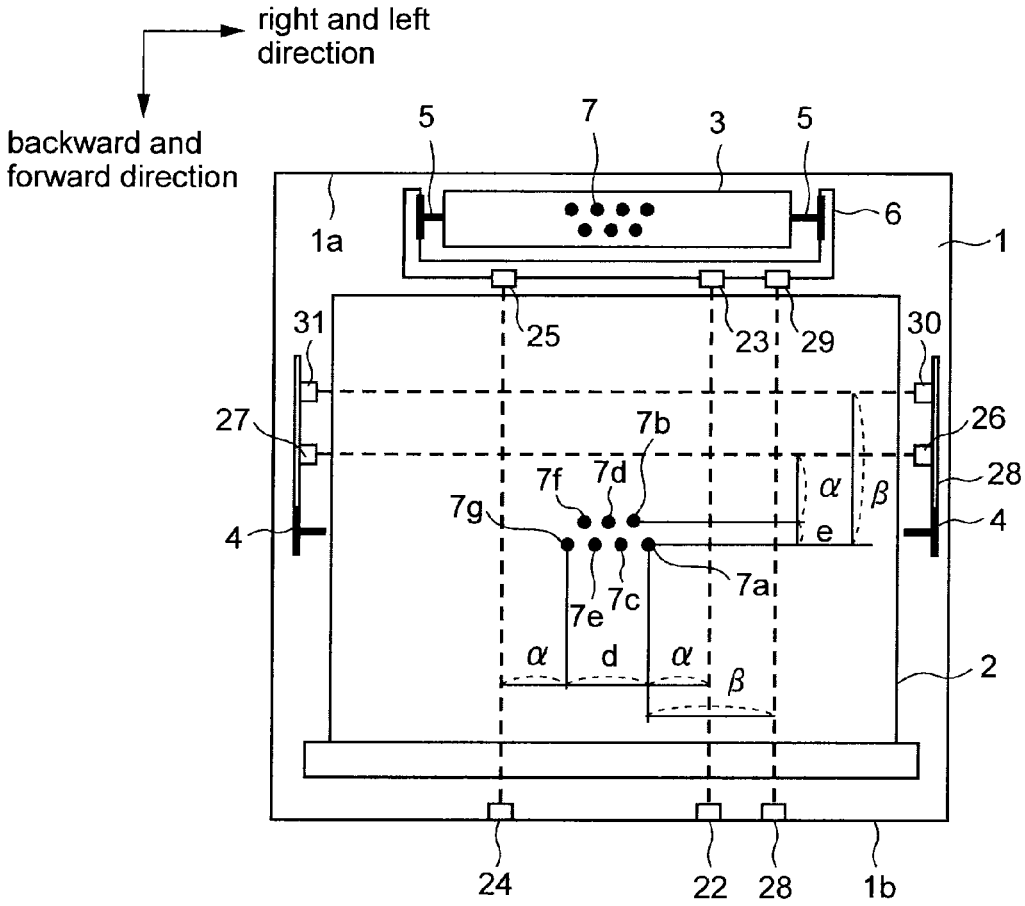
FIG. 18 is a plan view of the elevator hoistway showing another arrangement of the photoelectric sensors of Embodiment 2 according to the present invention.

As shown in FIG. 18, detection lines serving as the second detection level for back and forward sways may be provided, while taking into account the characteristic of the beam emitting component, on a same horizontal cross section of the hoistway, or may be provided at a position shifted in a height direction.

According to Embodiment 2 of the present invention, rope sways can be reliably detected without delay and an increase in the number of sensors, in a case where unevenness in the tensions of a plurality of ropes causes the ropes to sway out of sync.

Embodiment 3

Figure 19:
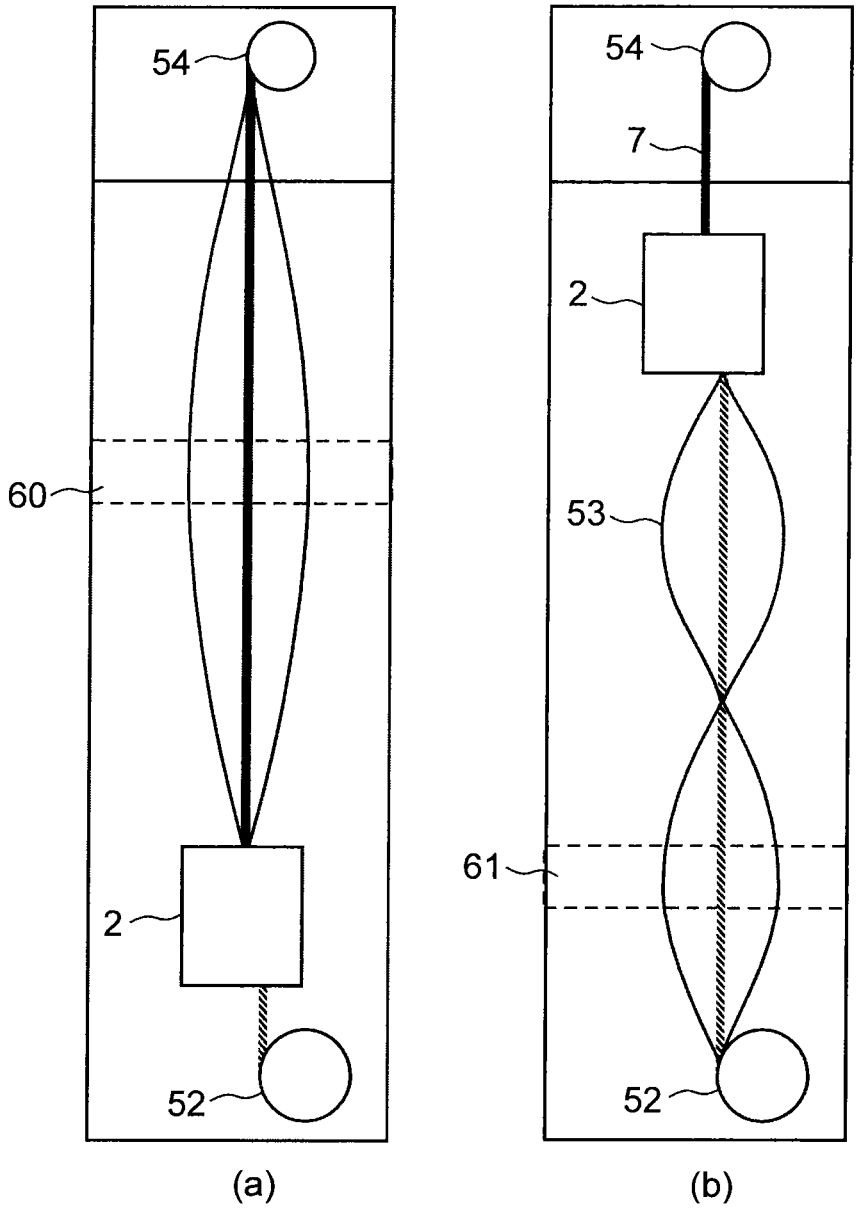
FIG. 19 is an example illustrating a position in a hoistway where an elevator rope sway detection device of Embodiment 3 according to the present invention is positioned.

FIG. 19 illustrate examples that indicate where to install, in a hoistway, an elevator rope sway detection device of Embodiment 3 according to the present invention. FIG. 19 (*a*) indicates a position 60 provided for installing a main rope sway detector, and FIG. 19 (*b*) indicates a position 61 provided for installing a compensation rope sway detector. An example is shown in which the main rope sway detector position 60 is located at the maximum amplitude position of the main rope, when the car is located at a position where the building shake period becomes identical to the first order vibration mode period of the main rope determined by the main rope length, the main rope tension, and the main rope linear density. An example is shown in which the compensation rope sway detector position 61 is located at the maximum amplitude position of the compensation rope, when the car is located at a position where the building shake period becomes identical to the second order vibration mode period of the compensation rope determined by the compensation rope length, the compensation rope tension, and the compensation rope linear density.

Because the main rope sway detector position 60 is the maximum amplitude position of the first order vibration mode in the main rope, the detection device position is set at a height equal to a half of a main rope length placed between the car and the driving pulley. Because the compensation rope sway detector position 61 is also the maximum amplitude position of the second order vibration mode in the compensation rope, the detection device position is set at a height equal to a quarter of a compensation rope length placed between the car and the balance pulley.

According to Embodiment 3 of the present invention, the rope sway detector is arranged at a position where a rope, i.e. the detection target, sways with the maximum amplitude in a vibration mode, and the rope sway can be detected at a position where the rope gets the closest to hoistway devices when the rope sways. Therefore, since elevator operation instructions are issued according to the rope sway amount, damages caused by contact between the rope and the hoistway devices can be forestalled.

In FIG. 19 (*b*), an example has been shown in which the compensation rope sway detector position 61 is set at a height equal to a quarter of the compensation rope length; however, the position may be set, for the second order vibration mode of the compensation rope, at a height equal to three quarters of the compensation rope length.

Explanations have been made using the examples in which the rope sway detector position is set at a height equal to a half or a quarter of the rope length; however, if the hoistway condition does not allow such settings, the position may be shifted to its neighborhood, which also gives a similar effect.

Figure 20:
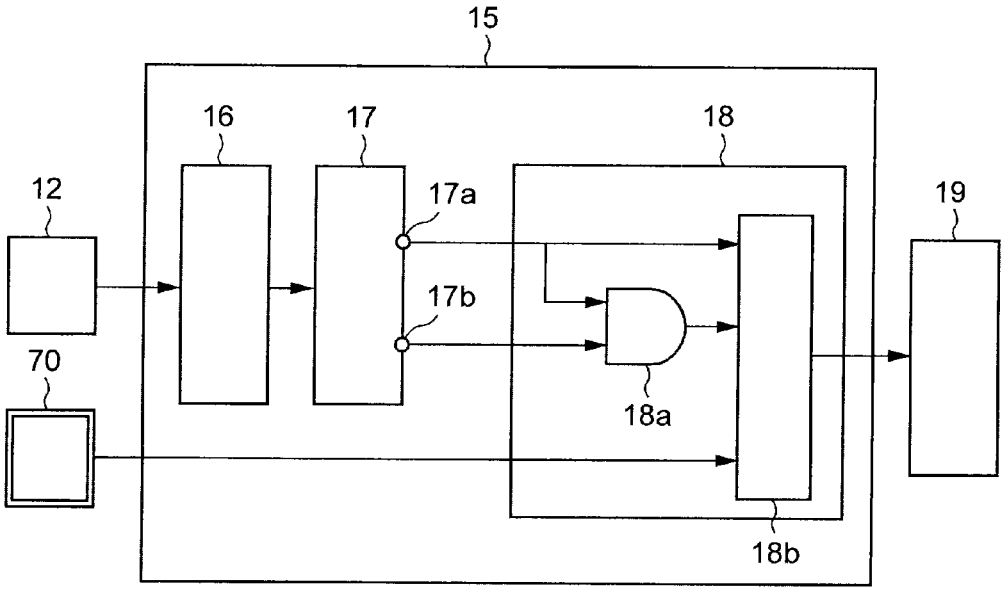
FIG. 20 is a signal block diagram of the elevator rope sway detection device of Embodiment 3 according to the present invention.

Furthermore, a configuration may be applied to the elevator rope sway detection device of Embodiment 3 as shown in a signal block diagram of FIG. 20, in which information 70 about the elevator car position is inputted to the rope sway determination unit 18 so that the rope sway determination unit CPU 18*b* determines a rope sway occurrence on the basis of the signals from the detection signal calculation unit 17 and the elevator car position information 70.

By using the above configuration of Embodiment 3 according to the present invention, rope sways can be detected according to the elevator car position even in a case where the elevator car passes through or stops at the rope sway detector position, and then the elevator car or an elevator device makes the photoelectric sensor turn OFF, which could be falsely detected as a rope sway detection. This enables a more efficient detection of rope sways.

NUMERALS

1 hoistway
1*a*, 1*b* hoistway walls
2 car
3 counter weight
4 car guide rail
5 counter weight guide rail
6 support bracket
7 main rope
7*a*, 7*b*, 7*c*, 7*d*, 7*e*, 7*f*, 7*g* above-car suspender parts
8 first beam emitting component
9 first beam receiving component
10 second beam emitting component
11 second beam receiving component
12 rope sway detector
13 rope sway detection means
14 building shake detector
15 rope sway determiner
16 detection signal memorization unit
17 detection signal calculation unit
17*a* first-detection-signal activation timing
17*b* second detection signal activation timing
18 rope sway determination unit
18*a* AND circuit
18*b* rope sway determination unit CPU
19 elevator controller
20 beam axis spread
21 reflection path
22 first beam emitting component for right and leftward sway detection of above-car suspender part 7*a*
23 first beam receiving component for right and leftward sway detection of above-car suspender part 7*a*
24 first beam emitting component for right and leftward sway detection of above-car suspender part 7*g*
25 first beam receiving component or right and leftward sway detection of above-car suspender part 7*g*
26 first beam emitting component for back and forward sway detection of above-car suspender part 7*b*
27 first beam receiving component for back and forward sway detection of above-car suspender part 7*b*
28 second beam emitting component for right and leftward sway detection of above-car suspender part 7*a*
29 second beam receiving component for right and leftward sway detection of above-car suspender part 7*a*
30 second beam emitting component for back and forward sway detection of above-car suspender part 7*b*
31 second beam receiving component for back and forward sway detection of above-car suspender part 7*b*
50 machine room
51 traction machine
52 balance pulley
53 compensation rope
54 driving pulley
60 main rope sway detector position
61 compensation rope sway detector position
70 elevator car position information

The invention claimed is:

1. An elevator rope sway detection device that detects sways of ropes installed in a hoistway of an elevator, comprising:

a sway detector that has two or more different levels for detecting predetermined sway displacements of the elevator ropes;

a detection signal memorization unit that memorizes detection signal information from the sway detector;

a detection signal calculation unit that performs a predetermined calculation using the detection signal information memorized in the detection signal memorization unit;

a rope sway determination unit that determines, on the basis of a result calculated by the detection signal calculation unit, whether or not the detection signal information is produced by a rope sway; and an elevator controller that controls, on the basis of a result determined by the rope sway determination unit, the elevator so that the elevator performs a predetermined operation, wherein the sway detector has two or more different detection lines configured by using beam emitting components for emitting beams and beam receiving components for receiving the emitted beams, that are installed on a fixed structure of the hoistway, wherein the detection lines have two different detection levels for detecting rope sways in right and left directions in which rope installation intervals are large, wherein two first detection lines are provided a same distance apart from a rightmost rope and a leftmost rope, and one or more second detection lines are provided for either the rightmost rope or the leftmost rope, and wherein the detection lines are provided at positions shifted in a width direction and a height direction by predetermined distances which are determined by a beam spread characteristic of the beam emitting components.

2. An elevator system including the elevator rope sway detection device of claim 1, wherein the elevator controller controls the elevator on the basis of elevator operation instructions determined by the rope sway determination unit, and the elevator operation instruction is any one of an operation for moving to a nearest floor and halting, an operation for evacuating to a floor where rope resonance does not occur, or an emergency halt.

3. An elevator rope sway detection device that detects sways of ropes installed in a hoistway of an elevator, comprising:

a sway detector that has two or more different levels for detecting predetermined sway displacements of the elevator ropes;

a detection signal memorization unit that memorizes detection signal information from the sway detector;

a detection signal calculation unit that performs a predetermined calculation using the detection signal information memorized in the detection signal memorization unit;

a rope sway determination unit that determines, on the basis of a result calculated by the detection signal calculation unit, whether or not the detection signal information is produced by a rope sway; and an elevator controller that controls, on the basis of a result determined by the rope sway determination unit, the elevator so that the elevator performs a predetermined operation, wherein the sway detector has two or more different detection lines configured by using beam emitting components for emitting beams and beam receiving components for receiving the emitted beams, that are installed on a fixed structure of the hoistway, wherein each of the detection lines has a detection level out of two different detection levels for detecting rope sways in back and forward directions in which rope installation intervals are small, and wherein the detection lines are provided at positions shifted in a width direction and a height direction by predetermined distances which are determined by a beam spread characteristic of the beam emitting components.

4. An elevator system including the elevator rope sway detection device of claim 3, wherein the elevator controller controls the elevator on the basis of elevator operation instructions determined by the rope sway determination unit, and the elevator operation instruction is any one of an operation for moving to a nearest floor and halting, an operation for evacuating to a floor where rope resonance does not occur, or an emergency halt.

5. An elevator rope sway detection device that detects sways of ropes installed in a hoistway of an elevator, comprising:

a sway detector that has two or more different levels for detecting predetermined sway displacements of the elevator ropes;

a detection signal memorization unit that memorizes detection signal information from the sway detector;

a detection signal calculation unit that performs a predetermined calculation using the detection signal information memorized in the detection signal memorization unit;

a rope sway determination unit that determines, on the basis of a result calculated by the detection signal calculation unit, whether or not the detection signal information is produced by a rope sway; and an elevator controller that controls, on the basis of a result determined by the rope sway determination unit, the elevator so that the elevator performs a predetermined operation, wherein only under a condition that a small detection level among the different detection levels is activated, the rope sway determination unit determines that a large detection level is validly activated by a rope sway.

6. The elevator rope sway detection device according to claim 5, wherein the detection signal calculation unit holds timings at which the small detection level and the large detection level are first activated and sends the timings to the rope sway determination unit, and wherein the rope sway determination unit includes an AND circuit that makes valid the activation of the large detection level only under the condition that the small detection level sent from the detection signal calculation unit is activated, and a rope sway determination unit CPU that determines a rope sway based on an output from the AND circuit and a signal holding the activation timing for the small detection level.

7. The elevator rope sway detection device according to claim 6, wherein the sway detector has two or more different detection lines configured by using beam emitting components for emitting beams and beam receiving components for receiving the emitted beams, that are installed on a fixed structure of the hoistway, wherein the detection lines have two different detection levels for detecting rope sways in right and left directions in which rope installation intervals are large, wherein two first detection lines are provided a same distance apart from a rightmost rope and a leftmost rope, and one or more second detection lines are provided for the rightmost rope or the leftmost rope, and wherein the detection lines are provided at positions shifted in a width direction and a height direction by predetermined distances which are determined by a beam spread characteristic of the beam emitting components.

8. The elevator rope sway detection device according to claim 7, wherein the sway detector has two or more different detection lines configured by using beam emitting components for emitting beams and beam receiving components for receiving the emitted beams, that are installed on a fixed structure of the hoistway, wherein each of the detection lines has a detection level out of two different detection levels for detecting rope sways in back and forward directions in which rope installation intervals are small, and wherein the detection lines are provided at positions shifted in a width direction and a height direction by predetermined distances which are determined by a beam spread characteristic of the beam emitting components.

9. An elevator system comprising:

the elevator rope sway detection device according to claim 5, wherein the elevator controller controls an elevator on the basis of an elevator operation instruction determined by the rope sway determination unit.

10. The elevator system according to claim 9, wherein the elevator operation instruction is any one of an operation for moving to a nearest floor and halting, an operation for evacuating to a floor where rope resonance does not occur, or an emergency halt.

* * * * *